US005244033A

United States Patent [19]

Ueno

[11] Patent Number: 5,244,033

[45] Date of Patent: Sep. 14, 1993

[54] DIECASTING APPARATUS

[75] Inventor: Toyoaki Ueno, Yamaguchi, Japan

[73] Assignee: Ube Industries, Inc., Ube, Japan

[21] Appl. No.: 853,080

[22] Filed: Mar. 17, 1992

[30] Foreign Application Priority Data

Mar. 25, 1991 [JP] Japan ..... 3-060328

[51] Int. Cl.[5] ..... B22D 17/30

[52] U.S. Cl. ..... 164/312; 164/337

[58] Field of Search ..... 164/312, 337

[56] References Cited

U.S. PATENT DOCUMENTS

| | | | |
|---|---|---|---|
| 3,248,759 | 5/1966 | Burkett | 164/312 X |
| 3,254,377 | 6/1966 | Morton | 164/312 X |
| 4,753,283 | 6/1988 | Nakano | 164/312 |
| 4,795,126 | 1/1989 | Crandell . | |
| 4,989,663 | 2/1991 | Kitamura | 164/312 |
| 4,991,641 | 2/1991 | Kidd et al. . | |

FOREIGN PATENT DOCUMENTS

| | | | |
|---|---|---|---|
| 2947602 | 5/1981 | Fed. Rep. of Germany . | |
| 3218326 | 12/1982 | Fed. Rep. of Germany . | |
| 3222828 | 12/1983 | Fed. Rep. of Germany . | |
| 57-39069 | 3/1982 | Japan | 164/133 |
| 62-207559 | 9/1987 | Japan | 164/312 |
| 62-286659 | 12/1987 | Japan | 164/312 |
| 63-84753 | 4/1988 | Japan | 164/312 |

*Primary Examiner*—J. Reed Batten, Jr.
*Attorney, Agent, or Firm*—Kanesaka and Takeuchi

[57] ABSTRACT

A diecasting apparatus is mainly composed of: a mold unit having a movable mold and a stationary mold both of which have mold cavities in the meeting surfaces thereof and, also having an inlet formed at a lower portion of the mold unit and a vertical passage extending from the inlet upward to the mold cavity, and further having a sleeve connected to the inlet and thus communicating with the mold cavities through the inlet and the passage; and a supplying unit for supplying molten metal into the sleeve. A supplying passage is provided in the stationary mold, and has one of its openings at the inner surface of the inlet of the vertical passage, and communicates with the outside of the stationary mold. A duct connects the supplying passage and the supplying unit. A molten-metal heater is provided on the duct. A valve mechanism for opening and closing the supplying passage is composed of a valve seat and a valve. The valve seat is provided in the supplying passage, close to the inlet or the vertical passage, and is tapered so as to become wider toward the movable mold. The valve is supported by the movable mold and is moved to and away from the the valve seat by a driving unit.

9 Claims, 5 Drawing Sheets

DIECASTING APPARATUS

BACKGROUND OF THE INVENTION

1. Field of the Invention

The present invention relates to a diecasting apparatus and, more particularly, to a diecasting apparatus whose mechanism for supplying molten metal is improved so as to be suitable for diecasting of magnesium alloys.

2. Description of the Related Art

In a conventional diecasting apparatus comprising a supplying unit for supplying molten metal into a sleeve, and a mold unit having an inlet provided at a lower part thereof to which the sleeve is connected, a molten metal passage (a runner portion) extending vertically and a mold cavity communicating with the sleeve through the inlet and the molten metal passage, a diecasting operation is performed by: supplying molten metal into the sleeve; connecting the sleeve to the inlet at the bottom portion of the mold unit; and raising a plunger to send (inject) the molten metal stored in the sleeve into the mold cavity.

A ladle is used to pour molten metal into the sleeve after the sleeve is detached from the mold unit.

For an easier method of pouring molten metal with the ladle, the sleeve is tilted (e.g. as shown in FIG. 3 of Japanese Patent Publication No. 57-21414), or while being maintained vertically, the sleeve is moved away from the bottom of the mold unit (e.g. as shown in FIG. 4 of the above-mentioned patent specification).

FIG. 2 of the same patent specification shows a pouring method in which while the sleeve is connected to the lower mold, the lower mold is descended, and molten metal is poured from the ladle down into the descended lower mold through the molten metal passage.

In the above-described ladle-pouring method in which the sleeve is detached from the mold unit, a long interval is required between the pouring of molten metal into the sleeve and the injection of the molten metal into the mold cavity, and contamination is likely to occur. Further, in the pouring method in which the sleeve is tilted, the capacity of the sleeve cannot be fully utilized, so the sleeve must be made larger (longer) to compensate for the dead volume.

In the pouring method in which molten metal is poured down through the lower mold into the sleeve while the sleeve and the lower mold are kept connected, the injection of the molten metal poured in the sleeve can not be performed until the lower and upper molds are clamped. In other words, it takes a long time before the injection. Also, while being poured through the lower mold into the sleeve, the molten metal may spill on the top surface of the lower mold, i.e. the mating surface thereof.

In any of the methods described above, the molten metal is exposed to the atmosphere while poured into the sleeve, or even until the sleeve is connected to the inlet in such a method. The molten metal may well oxidize when exposed to the atmosphere. Thus, the above-described methods are unsuitable for diecasting of metals which easily oxidize (e.g., magnesium, aluminium and alloys thereof). Even in the case of diecasting of metals which do not so easily oxidize, an oxide may be produced or trapped therein to cause defects in the cast product.

SUMMARY OF THE INVENTION

It is an object of the present invention to provide a diecasting apparatus in which molten metal can be smoothly supplied into a sleeve without fear of spillage.

It is another object of the present invention to provide a diecasting apparatus which can cast easy-to-oxidize metals such as magnesium without oxidization.

Still another object of the present invention is to provide a diecasting apparatus which facilitates shortening the cycle of the diecasting operation.

The further objects, features and advantages of the present invention will become apparent in the below description.

A diecasting apparatus according to the first aspect of the present invention comprises, a mold unit having a movable mold and a stationary mold both of which have mold cavities in the meeting surfaces thereof and, also having an inlet formed at a lower portion of the mold unit and a vertical passage extending from the inlet upward to the mold cavity, and further having a sleeve connected to the inlet and thus communicating with the mold cavities through the inlet and the passage; and a supplying unit for supplying molten metal into the sleeve. Such a diecasting apparatus further comprises: a supplying passage provided in the stationary mold and having one of its openings at the inner surface of the inlet of the vertical passage and communicating with the outside of the stationary mold; a duct connecting the supplying passage and the supplying unit; molten metal heating means provided on the duct; and valve means for opening and closing the supplying passage, including a valve seat and a valve, the valve seat being provided in the supplying passage, close to the inlet or the vertical passage, and being tapered so as to become wider toward the movable mold, the valve being supported by the movable mold and being moved to and away from the valve seat by a driving means.

A diecasting apparatus according to the second aspect of the present invention, comprises: a mold unit having a movable mold and a stationary mold both of which have mold cavities in the meeting surfaces thereof and, also having an inlet formed at a lower portion of the mold unit and a vertical passage extending from the inlet upward to the mold cavity, and further having a sleeve connected to the inlet and thus communicating with the mold cavities through the inlet and the passage; and a supplying unit for supplying molten metal into the sleeve. Such a diecasting apparatus further comprises: a supplying passage provided so as to extend substantially horizontally in the stationary mold and having one of its openings at the inner surface of the inlet of the vertical passage; a duct having one of its opening at bottom-side inner surface of a rear portion of the supplying passage and communicating with the supplying unit; molten metal heating means provided on the duct; and valve means for opening and closing the supplying passage, including a valve seat and a valve, the valve seat being provided in the supplying passage, close to the inlet or the vertical passage, and being tapered so as to become wider toward the movable mold, the valve being supported by the movable mold and being moved to and away from the valve seat by a driving means.

In a diecasting apparatus according to the present invention, the valve means is opened and molten metal is supplied form the supplying unit through the inlet or the vertical passage in the mold unit into the pouring sleeve while the pouring sleeve is connected to the inlet of the clamped molds. When a predetermined amount of molten metal is supplied into the pouring sleeve, the valve means is closed and the injection plunger is raised to inject the molten metal into the mold cavity.

Thus, in a diecasting apparatus according to the present invention, the injection of molten metal can be performed immediately after molten metal is supplied into the pouring sleeve. During the supplying of molten metal, spillage of the molten metal never occurs. Also, the sleeve can always be positioned vertically so that molten metal can be poured up to the upper edge of the sleeve. Thus, the length of the pouring sleeve can be made minimal.

In a diecasting apparatus according to the present invention, molten metal is never exposed to the atmosphere over the course thereof from the supplying unit into the mold cavity. Therefore, even easy-to-oxidize metals can be cast without any practical problems, and defects caused by oxides are eliminated. Also, a diecasting apparatus according to the present invention is very useful for diecasting molten magnesium alloys which easily explode when exposed to the atmosphere.

Since the duct is provided with a heater, the molten metal left in the duct stays melted and can be immediately used for the next supply. Thus, the time required for the supplying operation can be substantially reduced.

In a diecasting apparatus according to the present invention, the supplying passage is opened by moving the valve supported in the movable mold away from the valve seat provided in the stationary mold and is closed by moving the valve to the valve seat. The stationary mold is not provided with a supporting member for slidably supporting the valve, and thus, the sliding surface of the supporting member does not face the internal surface of the passage. As a result, the sealing of the passage is secured.

DETAILED DESCRIPTION OF THE PREFERRED EMBODIMENTS

Figure 1:
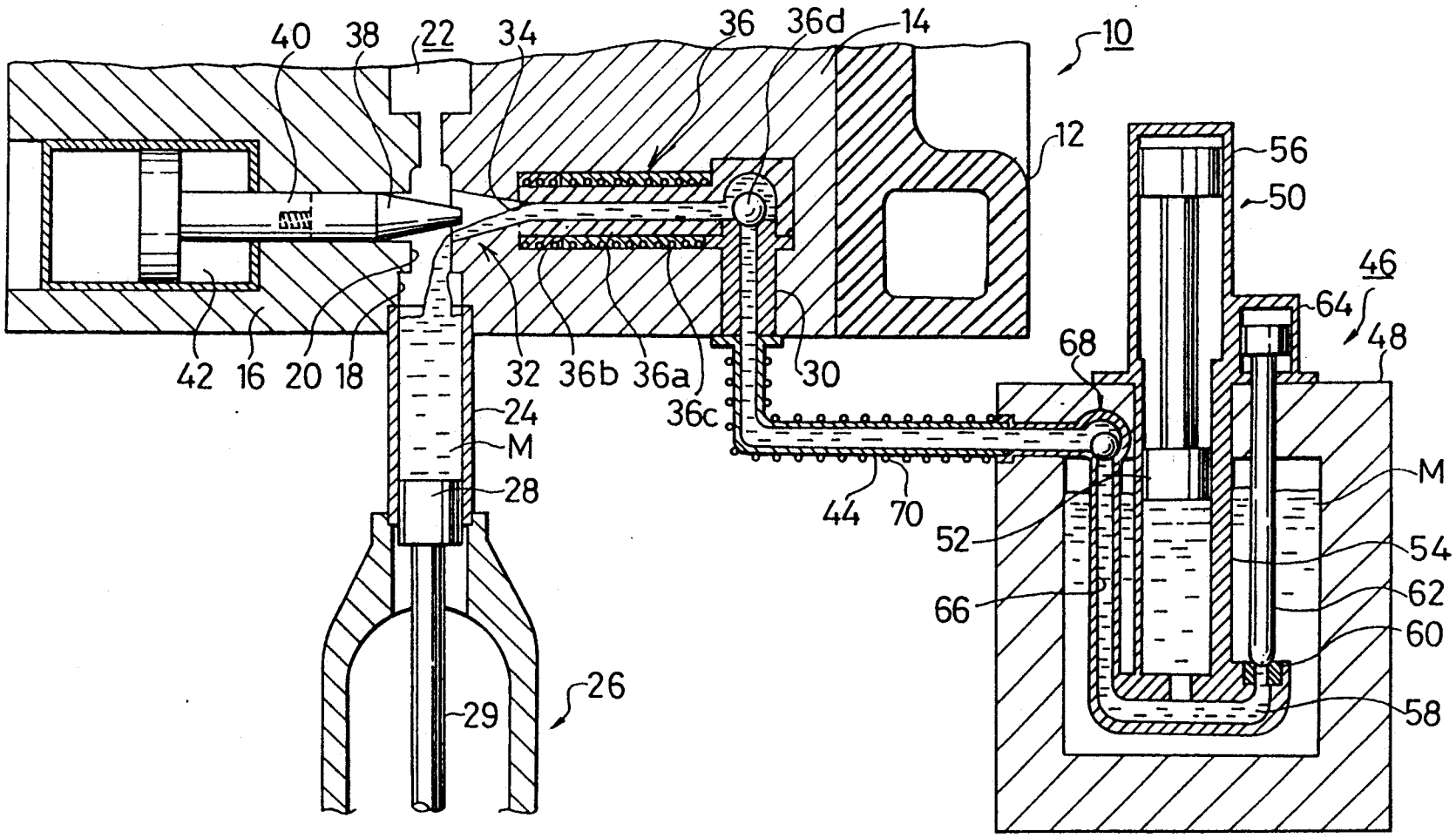
FIG. 1 is vertical sectional view of a main portion of a diecasting apparatus according to the first embodiment of the present invention.

The first embodiment of the present invention will be described with reference to FIGS. 1 and 2.

A mold unit 10 comprises a stationary mold 14 fixed on a stationary board 12 and a movable mold 16 which is moved toward and away from the stationary mold 14 (to the left and right in the figures), e.g., by means of a toggle mechanism (not shown). An inlet 18 is formed at a bottom portion of the mold unit 10 composed of the stationary and movable molds 14, 16. The inlet 18 is connected through a runner portion 20 to a mold cavity 22. Through such a passage, a molten metal is introduced into the mold cavity 22.

The inlet 18 is adapted to engage with the upper end portion of a pouring sleeve 24. The pouring sleeve 24 is provided on an upper end portion of an injection unit 26. An injection plunger 28 is fitted in the pouring sleeve 24. The injection plunger 28 is connected by a rod 29 to an injection cylinder (not shown) which moves the injection plunger 28 up and down.

The inlet 18 is connected to the outside of the mold unit 10 through a passage 30 which is formed in the stationary mold 14 so as to have one of its openings at the inner periphery of the runner portion 20. Thus, molten metal is supplied from an external source through the passage 30 to the inlet 18. A valve means 32 is provided in the passage 30, near the inlet 18. The valve means 32 includes a valve seat 34 and a valve 38. The valve seat 34 is tapered so as to become wider toward the movable mold 16. The valve 38 is formed so as to be seated on the valve seat 34 and is movably supported in the movable mold 16. The valve 38 is connected, by a screwing means, to a rod 40 of a cylinder (a device for driving the valve means) 42. Instead of the cylinder 42, a solenoid may be used.

A well 36 is provided at a midway portion of the passage 30. The well is composed of an inner liner **36*a* and a heat insulating member 36*f* wrapping the inner liner 36*a*. The inner liner 36*a* comes into direct contact with the molten metal and is formed of ceramic or heat resisting metal (e.g., SKD61). Induction heating coils (induction heater) 36*b*, 36*c* are provided so as to surround the heat-insulating member 36*f*. Thus, the molten metal in the well 36 can be heated by supplying current to the induction heating coils 36*b*, 36*c*. The coil 36*b* is placed near the valve seat 34 and is electrically separated from the coil 36*c*. By means of the coil 36*b*, the temperature of molten metal close to the valve seat 34 can be controlled independently from the rest of the molten metal in the well 36**.

The well 36 is provided with a check valve **36*d* at the upstream end thereof. The check valve 36*d*** prevents a back flow of the molten metal.

The passage 30 is connected through a duct 44 to a supplying unit 46. The supplying unit 46 comprises a tank 48 for storing molten metal and a pump means 50 for pumping out the molten metal from the storing tank 48. The pump means 50 is composed of a cylinder barrel 54, a piston 52 inserted in the cylinder barrel 54, and cylinder 56 for moving the piston 52 up and down. The storing tank 48 is connected through a suction inlet 60 and a passage 58 to the inside of the cylinder barrel 54.

A rod valve 62 is provided at the suction inlet 60. A valve cylinder 64 moves the rod valve 62 up and down to open and close the suction inlet 60. A check valve 68 is provided at a halfway portion of a passage 66. The molten metal in the barrel 54 is conveyed through the passage 66 and the check valve 68 to the duct 44. A heater 70 is provided around the duct 44.

In a diecasting apparatus constructed as described above, if the piston 52 is raised while the suction inlet 60 is open (the rod valve 62 is raised), the molten metal M flows from the storing tank 48 into the barrel 54. Next, the suction inlet is closed by the rod valve 62, and the valve 38 is moved back to open the valve means 32. If the piston 52 is lowered in such a condition, the molten metal M flows out of the barrel 54 through the passage 66, the check valve 68, the duct 44, the passage 30 and the runner portion 20 into the inlet 18. Preferably, the plunger 28 should be raised as high as possible beforehand and be lowered gradually as the molten metal M flows in.

When a sufficient amount of molten metal M is stored in the pouring sleeve 24, the valve means 32 is closed by moving the valve 38 to meet the valve seat 34, and the injection plunger 28 is raised to inject the molten metal M into the mold cavity 22. Despite pressure caused by the injection of the molten metal, the check valves **36*d* and 68 according to this embodiment prevent the molten metal from flowing back to the storing tank 48**.

The above injection is followed by solidification of the molten metal, opening of the molds, taking-out of the product and mold clamping. Then, the molten metal is supplied to the pouring sleeve 24, as described above, for the next diecasting. The molten metal remaining in the well 36 and the duct 44 is maintained at a required temperature by the induction heating coils **36*b*, 36*c* and the heater 70. The molten metal near the valve means 32 in the well 36 is in semi-solidified state, so that the molten metal melted fully in the other part of the well 32 away from the valve means 32 does not flow out thereof toward the sleeve 24 even when the molds 12, 14 are opened. The semi-solidified metal is heated by the coil 36*b* and is melted before and during the molten metal is supplied, so that the molten metal is immediately supplied to the inlet 18**.

Immediately after the molten metal M is supplied to the pouring sleeve 24, the injection operation can be started simply by closing the valve means 32. Thus, the diecasting operation can be quickened, and an unnecessary decrease of the temperature of the molten metal stored in the pouring sleeve 24 can be avoided, so that partial solidification is also avoided. As a result, the quality of the cast products is upgraded.

As can be understood from the illustration in FIG. 1, the molten metal stored in the tank 48 is conveyed to the pouring sleeve 24 without being exposed to the atmosphere. Therefore, even molten metal easy to oxidize, such as aluminium or magnesium, can be cast without any oxidization, according to this embodiment. A wide variety of metals can be cast, and the defects caused by oxide are eliminated. As a result, high-quality cast products are obtained.

Also as can be understood from the illustration in FIG. 1, the only place where the molten metal can possibly leak is the portion connecting the stationary mold 14 with the duct 44. Such a possible leakage is prevented by employing a packing to seal the connecting portion. The packing employed in this embodiment is durable enough to provide a substantially-long-term sealing.

According to this embodiment, the cylinder 42 for moving the valve 38 to join with the valve seat 34 has a long stroke so that the valve 38 can be moved farther than the valve seat position when the mold is disassembled. This long-stroke cylinder 42 facilitates the cleaning (e.g. fettling), maintaining or replacing of the valve 38.

The valve 38, according to this embodiment, is provided with a cooling means, e.g. of water-cooling type, in order to protect the valve 38 from the heat of the molten metal. Also, such a cooling means can be used to enhance the sealing of the valve means 32. When the valve means 32 is substantially closed, the cooling means cools the molten metal between the valve 38 and the valve seat 34 to increase the viscosity or the molten metal or partially solidify it. Thus, leakage through the valve means 32 is substantially prevented. To open valve means 32, the molten or solidified metal adjacent to the valve seat 34 is selectively heated by the induction heating coil **36*b***.

Figure 2:
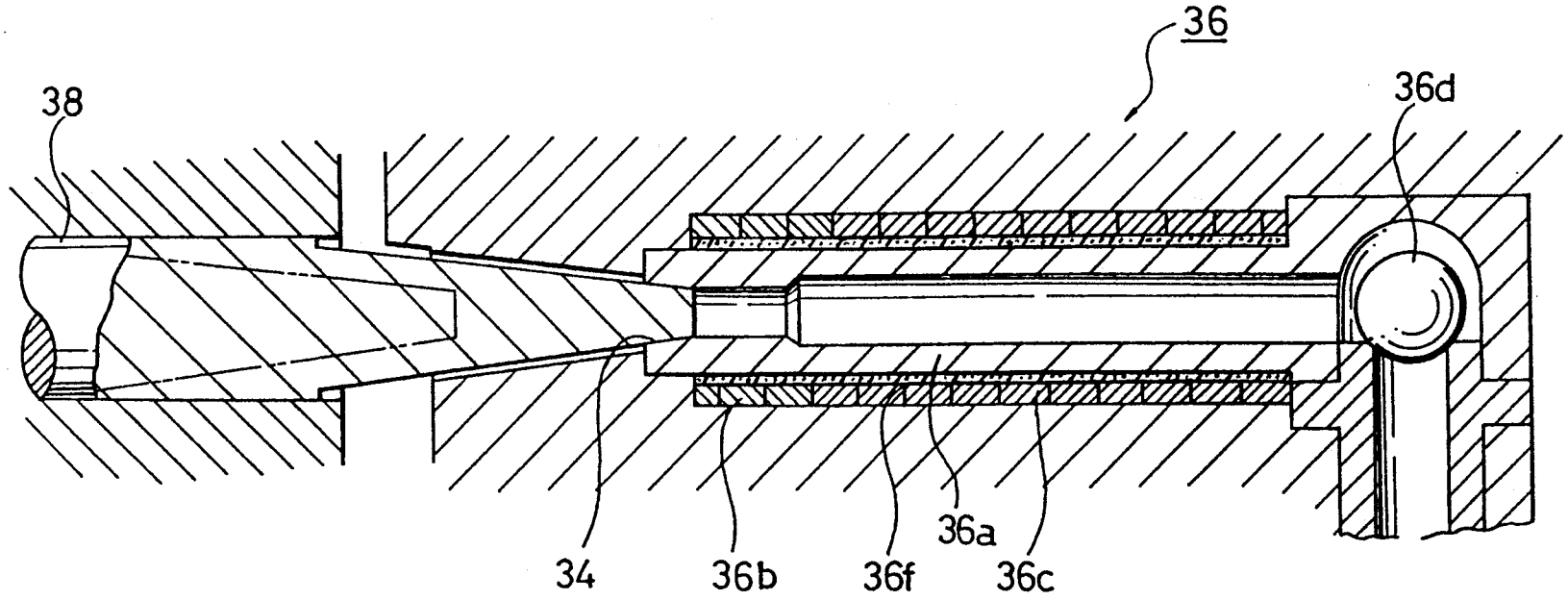
FIG. 2 is an enlarged view of the main portion of the apparatus shown in FIG. 1.

As shown in FIGS. 1, 2, the inner liner **36*a* according to this embodiment has the same inside diameter over its entire length. The valve seat 34 is tapered so as to become wider downstream. Thus, there is nothing to block or obstruct the smooth flow of the molten metal through the well 36 (or the passage 30**).

Since the movable mold 16 is moved horizontally away from the stationary mold 14 (the horizontal mold type), according to this embodiment, when the cast product is to be taken out, the solidified metal located from the valve means 32 toward the inlet 18 can be taken out together with the product.

As shown in FIG. 1, the pouring sleeve 24 according to this embodiment is connected to the inlet 18 so that it is always positioned vertically and never tilts during a diecasting operation. Thus, a substantial amount of molten metal can be stored in the pouring sleeve 24. The pouring sleeve 24 does not need to be so long as that in a known art.

Although the passage 30 has one of its openings at the runner portion 20 in the above embodiment, it may be directly connected to the inlet 18.

Although the pouring sleeve 24 is connected to the inlet 18 to assume a vertical position in the above embodiment, the pouring sleeve 24 may be connected to the inlet 18 which has its opening at the side surface of the mold, to take a horizontal or diagonal position.

The second embodiment of the present invention will be described with reference to FIGS. 3 through 7.

A mold unit 101 comprises a stationary mold 103 fixed on a stationary board 102 and a movable mold 105 which is moved toward and away from the stationary mold 103 (to the left and right in the figures), e.g., by means of a toggle mechanism (not shown). An inlet 106 is formed at the bottom portion of the mold composed of the stationary and movable molds 103, 105. The inlet 106 is connected through a runner portion 107 to a mold cavity 108. Through the inlet 106 and the runner portion 107, molten metal is introduced into the mold cavity 108.

The inlet 106 is adapted to engage with the upper end portion of a pouring sleeve 109. The pouring sleeve 109 is provided on the upper end portion of an injection unit 110. An injection plunger 111 is movably fitted in the pouring sleeve 109. The injection plunger 111 is connected by a rod 112 to an injection cylinder (not shown) which moves the injection plunger 111 up and down. The pouring sleeve 109 can be separated from the molds 103, 105 by lowering the sleeve 109 from the position thereof shown in FIG. 3. Then, the pouring sleeve 109 is horizontally swung or moved until the opening thereof is separated substantially apart from the molds. At such a position, the pouring sleeve 109 can be cleaned by spraying, or lubricant can be applied thereto.

The inlet 106 communicates with the outside of the molds through a passage 113 which is formed horizontally in the stationary mold 103 so as to have one of its openings at the runner portion 107. Thus, molten metal is supplied from an external source through the passage 113 to the inlet 106. The inner periphery of the horizontally-formed passage 113 is slightly tapered so that the passage 113 becomes wider toward the movable mold 105 and that all the molten metal in the passage flows down to the inlet 106. A valve means 114 is provided in the passage 113, near the inlet 106. The valve means 114 includes a valve seat 115 and a valve 116. The valve seat 115 is formed so as to become wider toward the movable mold 105. The valve 116 is formed so as to be seated on the valve seat 115 and is movably supported in the movable mold 105. The valve 116 is connected, by a screwing means, to a piston rod 118 of a cylinder (a device for driving the valve means) 117 which is connected at one of its ends to the movable mold 105. The valve 116 is slid through a guide bush 119. Instead of the cylinder 117, a solenoid may be used.

The passage 113 also functions as a well. The horizontal passage 113 is connected, at its upstream end and its bottom-side periphery, to a duct 120 which slopes down toward a supplying unit 123. The duct 120 comprises an inner liner 121. The inner liner 121 comes into direct contact with the molten metal and is formed of ceramic or heat resisting metal (e.g., SKD61). An induction heating coil (an induction heater) 121*a* and a heat insulating member 121*b* are provided around the inner liner 121. Such an induction heating coil or an inner liner made of ceramic or heat resisting metal may be provided around the passage 113 in the stationary mold 103.

The duct 120 sloped so as to convey molten metal to the passage 113 is connected to a horizontal duct 122, which is connected to the supplying unit 123. The supplying unit 123 comprises a tank 124 for storing molten metal and a pump means 125 for pumping out the molten metal stored in the tank 124. The pump means 125 includes a cylinder barrel 127, a piston 126 inserted in the cylinder barrel 127, and a cylinder 128 for moving the piston 126 up and down. The storing tank 124 is connected through a suction inlet 130 and a passage 129 to the inside of the cylinder barrel 127. The suction inlet 130 is opened or blocked by a rod valve 131. The rod valve 131 is moved up and down by a valve cylinder 132. The molten metal in the cylinder barrel 127 is conveyed through a passage 133 and a check valve 134 to the horizontal duct 122. The horizontal duct 122 is equipped with a heater 135.

Figure 3:
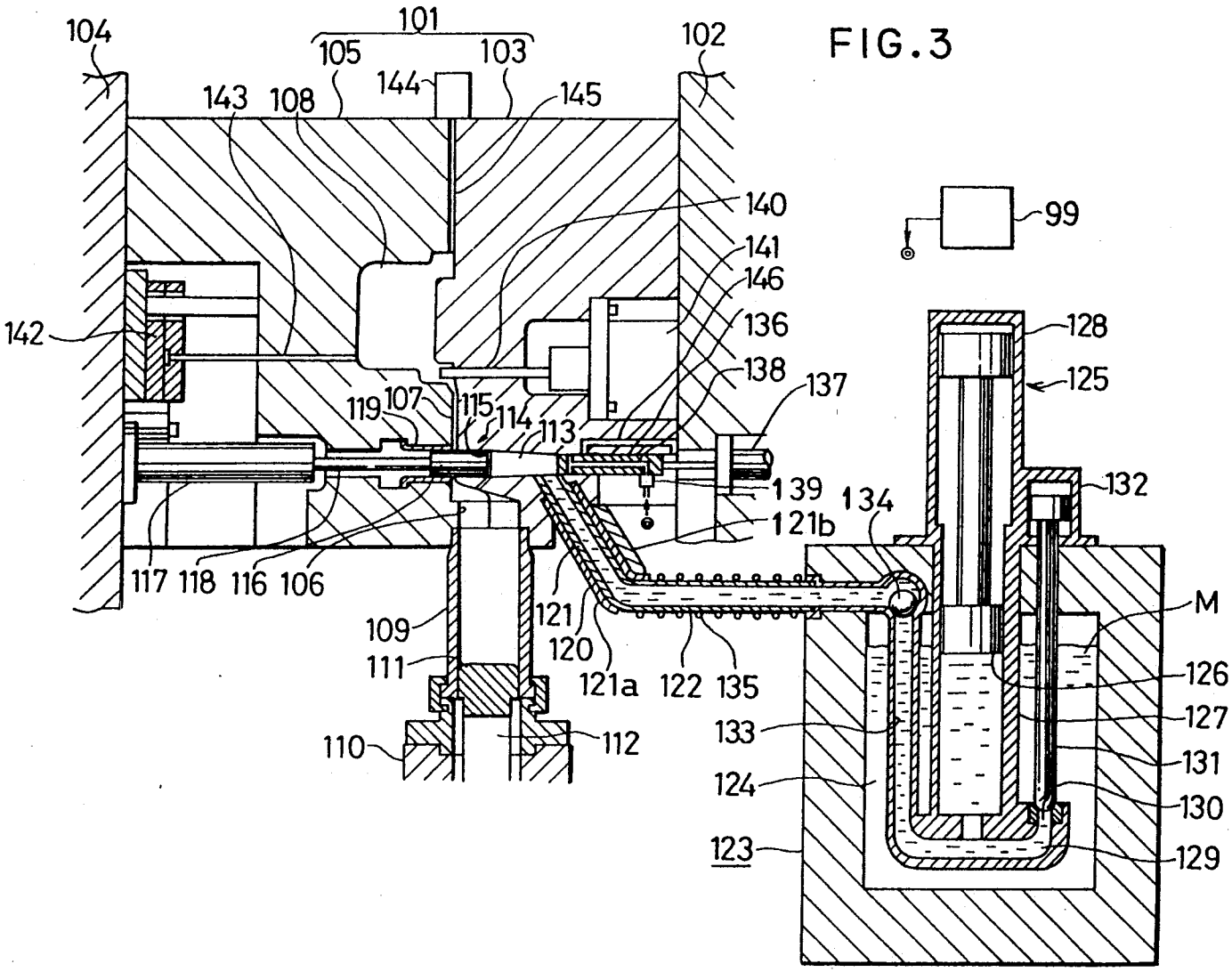
FIG. 3 is a vertical sectional view of a diecasting apparatus according to the second embodiment of the present invention.
Figure 4:
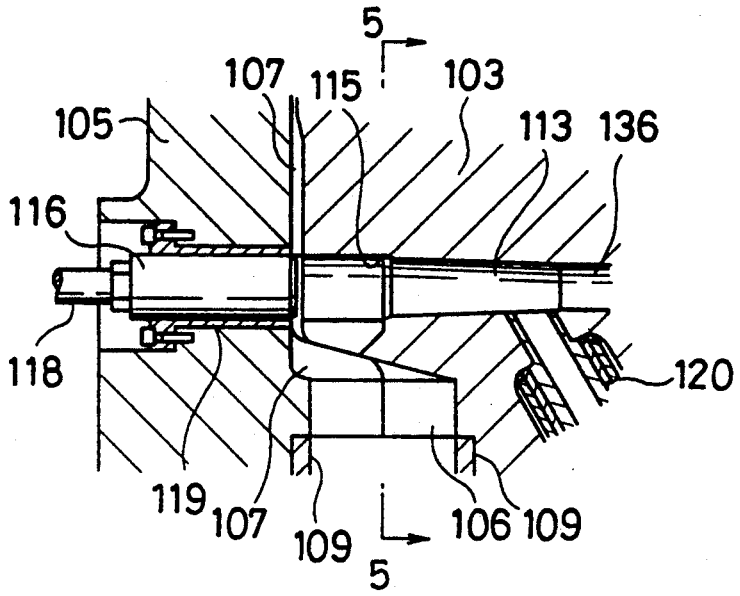
FIG. 4 illustrates a main portion of the apparatus shown in FIG. 3 during a pouring operation.
Figure 5:
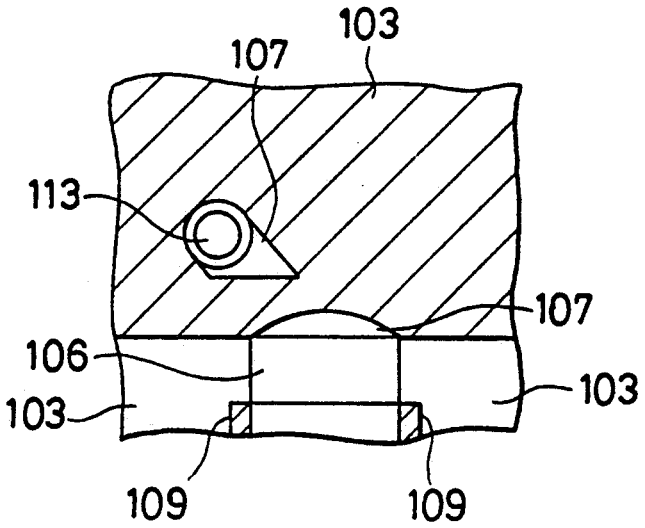
FIG. 5 is a sectional view taken along line 5—5 in FIG. 4.

Inside the stationary mold 103, a movable rod 136 is provided at one of the ends of the passage 113, the end closer to the stationary board 102. A cylinder 137 is fixed to the stationary board 102. The rod 136 is protruded into or retracted from the passage 113 by the action of the cylinder 137. A gas passage 138 is formed inside the rod 136, as shown in FIG. 3. One of the ends of the passage 138, i.e. the end closer to the cylinder 137, is connected by a connecting means 139 to a source 99 of inert gas such as nitrogen (not shown). The openings at the other end (the downstream end) of the gas passage 138 are provided at the outer periphery of the front end portion of the rod 136. Thus, when the rod 136 is protruded into the passage 113 which becomes wider toward the movable mold 105, the nitrogen is supplied from the openings of the gas passage 138 to the mold cavity 108 through a gap between the outer periphery of the front end portion of the rod 136 and the tapered inner periphery of the passage 113. A ventilation passage 146 is formed in the stationary mold 103 so as to communicate with the outside. The inside opening of the passage 146 is provided at a portion of the passage 113 where the rod 136 is slid through. When the rod 136 is retracted, the ventilation passage 146 is opened to connect the passage 113 to the atmosphere.

A pin 140 for feeding is connected to a cylinder 141 provided in a portion of the stationary mold 103. The cylinder 141 protrudes and retracts the pin 140. Numeral 142 denotes a product pushing-out means including a pushing pin 143. A known gas remover 144 is connected to the mold cavity 108 through a gas removing passage 145 formed on the mating surfaces of the molds 103 and 105.

The operation of the diecasting apparatus constructed as described above will be described. If the rod valve 131 is held up and the piston 126 is raised, the molten metal M stored in the tank 124 flows into the cylinder barrel 127. The check valve 134 provided at the junction of the passage 133 and the duct 122 keeps the molten metal M in the ducts 120 and 122 from flowing back to the cylinder barrel 127.

Then, the valve 116, the feeding pin 140 and the pushing pin 143 are drawn back to predetermined positions beforehand, and the molds 103, 105 are clamped as shown in FIG. 3. In a condition where the pouring sleeve 109 is connected to the bottom of the molds 103 and 105, the cylinder 137 is operated to project the rod 136 until the outlets of the gas passage 138, i.e. the tip portion of the rod 136, reach the tapered inner periphery of the molten-metal passage 113. Then, the inert gas such as nitrogen gas is let out of the outlets of the gas passage 138, e.g. by operating not-shown valves, into the mold cavity 108, the pouring sleeve 109, etc., until the inert gas (nitrogen) has completely replaced the air therein.

Next, the suction inlet 130 is closed by the rod valve 131, and the valve means 114 is opened by drawing back the valve 116. While such a state is maintained, if the piston 126 is lowered, the molten metal M flows out of the cylinder barrel 127 through the passage 133, the check valve 134, the ducts 122 and 120, the passage 113, the runner portion 107 and the inlet 106 to the pouring sleeve 109. Preferably, the injection plunger 111 should be raised to its uppermost position beforehand and lowered gradually as the molten metal M flows into the pouring sleeve 109. Such operation substantially prevents the molten metal from violently flowing, splashing, taking in air, losing its heat, etc. As the molten metal flows into the pouring sleeve 109, the nitrogen therein is forced out to the mold cavity 108 and then let out through the gas remover 144.

If the descend piston 126 comes to a stop, all the molten metal in the passage 113 flows down to the pouring sleeve 109 since the inner periphery of the passage 113 is tapered, and the molten metal remaining in the duct 120 fills the duct 120 up to the top thereof. Thus, the next supplying operation can be started quickly, and with less preparation.

When a sufficient amount of the molten metal is stored in the pouring sleeve 109, the operation of the pump means 125 is stopped. As mentioned above, all the molten metal in the passage 113 having a tapered inner periphery flows into the pouring sleeve 109, and the molten metal remaining in the duct 120 fills the duct 120 to the top thereof.

Figure 6:
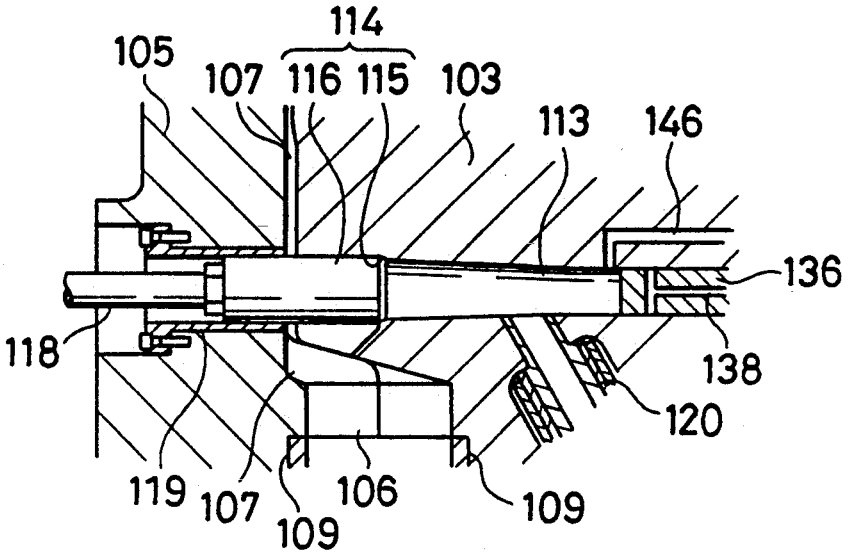
FIG. 6 illustrates the main portion shown in FIG. 4 during an injection operation.

Then, the valve means is closed by placing the valve 116 onto the valve 115 as shown in FIG. 6. The rod 136 is retracted to the position as shown in FIG. 6. While such a state is maintained, the injection plunger 111 is raised to inject the molten metal M into the mold cavity 108. As the molten metal is injected into the mold cavity 108, the nitrogen therein is forced out to the atmosphere through the gas removing passage 145 and the gas remover 144. When the surface of the molten metal M reaches a position adjacent to the gas remover 144, the valve of the gas remover 144 is closed by the inertia force of the molten metal or an electrical signal. Thus, the molten metal does not get into the gas remover 144 nor does it go outside. Cavitation does not occur in the molten metal nor in the cast product.

According to this embodiment, the valve means 114 prevents the molten metal M from flowing back to the passage 113 or the storing tank 124, despite the pressure caused by the injection. Also, should the molten metal flush into the passage 113 though a leak or gap in the valve means 114 during the high pressure injection or casting, the impact which the air in the passage 113 receives from the molten metal flushing in will be released through the ventilation passage 146, since the rod 136 is retracted so that the ventilation passage 146 communicates with the passage 113. Thus, the molten metal in the duct 120 will not be affected even in such a case. The above-mentioned incidental leak or gap may be caused, e.g. by a tiny fin deposited on a valve means 114.

During the injection, a feeding operation is performed by operating the cylinder 141 to project the feeding pin 140 while the mold cavity 108 is filled with the molten metal M.

Figure 7:
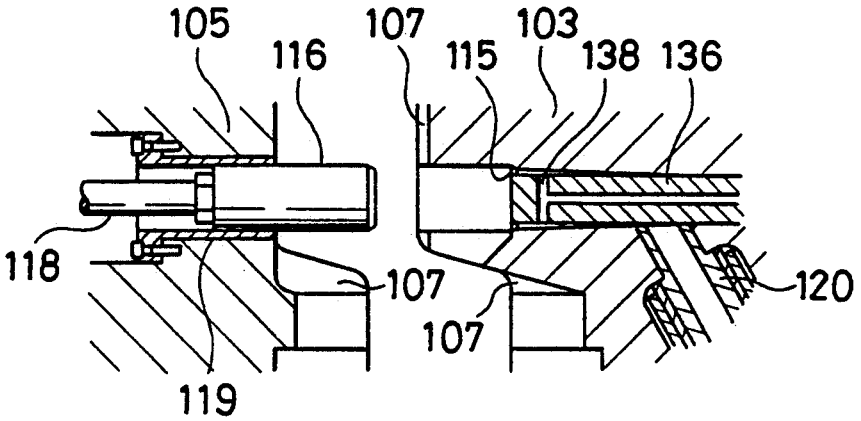
FIG. 7 illustrates the main portion shown in FIG. 4 when it is opened.

The molten metal in the mold cavity 108 is left to solidify and cool for a predetermined time after the injection. Then, while the molds are opened as shown in FIG. 7, the passage 113 is cleaned by the following procedure: operating the cylinder 137, as the molds are moved apart, to project the rod 136 until the rod 136 completely covers the opening of the duct 120 at the passage 113; and then spraying nitrogen gas, air or a lubricant through the gas passage 138 into the passage 113. After the cleaning operation, the cast product is taken out. For the next diecasting operation, the molds are clamped, and the molten metal is supplied into the pouring sleeve 109, as described above. Since the molten metal left in the ducts 120, 122 has been maintained at a required temperature by the induction heating coil 121*a* and the heater 135, the molten metal can be pumped to the inlet 106 immediately when desired.

Also, immediately after the pouring sleeve 109 is filled with the molten metal M, the injection operation can be started simply by closing the valve means 114. Thus, the diecasting operation can be quickened, and a temperature decrease in the molten metal stored in the pouring sleeve 109 can be avoided, so that partial solidification of the molten metal is also avoided. As a result, the quality of the products is upgraded.

As can be understood from the illustration in FIG. 3, the molten metal stored in the tank 124 is conveyed to the pouring sleeve 109 without being exposed to the atmosphere. Therefore, even molten metal easy to oxidize, such as aluminium or magnesium, can be cast without any oxidization, according to this embodiment. Also, a wide variety of metals can be cast, and the defects caused by oxide are eliminated. As a result, high-quality cast products are obtained.

According to this embodiment, the valve 116 may be provided with a cooling means, e.g. of a water-cooling type, in order to protect the valve 116 from the heat of the molten metal.

As shown in FIGS. 3 through 7, the inner peripheral surface of the passage 113 is tapered so as to become wider downstream, according to this embodiment. There is nothing to block or obstruct the smooth flow of the molten metal through the passage 113 (or the passage 30). Thus, no molten metal will be left in the passage 113 when the supplying operation is stopped.

Since the movable mold 105 is moved horizontally away from the stationary mold 103 (the horizontal type), according to this embodiment, when the cast product is to be taken out, the solidified metal (biscuit) located lower than the valve means 114 (toward the inlet 106) can be taken out together with the cast product.

As shown in FIG. 3, the pouring sleeve 109 according to this embodiment is connected to the inlet 106 so that it is always positioned vertically and never tilts during the diecasting operation. Thus, a substantial amount of molten metal can be stored in the pouring sleeve 109. The pouring sleeve 109 does not need to be as long as that of a known art. The pouring sleeve 109 can assume a position in which the inside thereof can be cleaned, by lowering it from the molds 103, 105 and pivoting it about the rotational center at a lower portion of the injection unit 110.

Although the molds are of the horizontal type in the above embodiments, the molds may be of the vertical type in which the movable mold is moved up and down.

As described above, since molten metal is conveyed through a closed passage, i.e. the duct, the passage and the inlet, into the pouring sleeve in the diecasting apparatus according to the present invention, the molten metal never leaks or spills. Also, since the molten metal is never exposed to the atmosphere during a pouring operation, even a metal easy to oxidize, such as magnesium, can be cast without oxidization. Naturally, the defects caused by oxide can be eliminated.

Since the time required for the pouring operation is substantially short according to the present invention, the casting cycle can be quickened, and also, with the temperature of the molten metal to be poured can be maintained sufficiently high. As a result, high-quality cast products can be obtained.

According to the present invention, favorable sealing of the passage provided in the stationary mold prevents leakage of molten metal from the passage.

According to the present invention, since the pouring sleeve is always positioned vertically, the pouring sleeve can store a substantial amount of molten metal or may be made relatively short while still retaining a required capacity.

A check valve may be provided in a portion connecting the duct to the supplying unit in order to enhance the prevention of flowing-back. Since the molten metal left in the ducts is maintained at a required temperature by the heater provided thereon, such molten metal can be immediately used for the next diecasting operation.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A diecasting apparatus comprising:

a mold unit having a movable mold and a stationary mold both of which have mold cavities in meeting surfaces thereof and, also having an inlet formed at a lower portion of said mold unit and a vertical passage extending from said inlet upward to said mold cavities, and further having a sleeve connected to said inlet and thus communicating with said mold cavities through said inlet and said passage;

a supplying unit for supplying molten metal into said sleeve;

a supplying passage provided in said stationary mold and having one of its openings at an inner surface of said vertical passage and communicating with an outside of said stationary mold;

a duct connecting said supplying passage and said supplying unit;

molten metal heating means provided on said duct; and valve means for opening and closing said supplying passage, including a valve seat and a valve, said valve seat being provided in said supplying passage, close to said inlet and said vertical passage, and being tapered so as to become wider toward said movable mold, said valve being supported by said movable mold and being moved to and away from said valve seat by driving means.

2. A diecasting apparatus according to claim 1, wherein said supplying passage is provided with a check valve for preventing the molten metal from flowing back to said supplying unit.

3. A diecasting apparatus according to claim 1, wherein said supplying unit is provided with a check valve for preventing the molten metal from flowing back from said mold unit.

4. A diecasting apparatus according to claim 2, further comprising a well portion which stores the molten metal and which is provided at a halfway portion of said supplying passage between said check valve and said valve seat.

5. A diecasting apparatus according to claim 2, further comprising heating means for heating the molten metal in said well portion.

6. A diecasting apparatus comprising:

a mold unit having a movable mold and a stationary mold both of which have mold cavities in meeting surfaces thereof and, also having an inlet formed at a lower portion of said mold unit and a vertical passage extending from said inlet upward to said mold cavities, and further having a sleeve connected to said inlet and thus communicating with said mold cavities through said inlet and said passage;

a supplying unit for supplying molten metal into said sleeve;

a supplying passage provided so as to extend substantially horizontally in said stationary mold and having one of its openings at an inner surface of said vertical passage;

a duct having one of its openings at a bottom-side inner surface of a rear portion of said supplying passage and communicating with said supplying unit;

molten metal heating means provided on said duct; and valve means for opening and closing said supplying passage, including a valve seat and a valve, said valve seat being provided in said supplying passage, close to said inlet and said vertical passage, and being tapered so as to become wider toward said movable mold, said valve being supported by said movable mold and being moved to and away from said valve seat by driving means.

7. A diecasting apparatus according to claim 2, wherein said supplying unit is provided with a check valve for preventing the molten metal from flowing back from said mold unit.

8. A diecasting apparatus according to claim 6, wherein said supplying passage inside the stationary mold is tapered so as to become gradually wider toward said movable mold.

9. A diecasting apparatus according to claim 8, further comprising a rod provided at a side of said supplying passage in the stationary mold, said rod being slidable to be located in the supplying passage and having a gas passage therein to provide a gas into said supplying passage.

* * * * *